US005412550A

United States Patent [19]

Hsieh et al.

[11] Patent Number: 5,412,550

[45] Date of Patent: May 2, 1995

[54] NIGHT LAMP HAVING A SAFETY DEVICE

[76] Inventors: Kuang Nan Hsieh; Wen Bin Hsieh, both of No. 1058 Jian Cheng Road, Taichung, Taiwan, Prov. of China

[21] Appl. No.: 323,016

[22] Filed: Oct. 14, 1994

[51] Int. Cl.[6] ..... H01R 33/00

[52] U.S. Cl. ..... 362/226; 362/95; 439/141

[58] Field of Search ..... 362/226, 95, 253; 439/139, 141

[56] References Cited

U.S. PATENT DOCUMENTS 4,445,739 5/1984 Wooten ..... 439/141
4,931,911 6/1990 Hanson ..... 362/226 X
5,339,231 8/1994 Parsolano et al. ..... 362/226

*Primary Examiner*—Stephen F. Husar
*Attorney, Agent, or Firm*—Morton J. Rosenberg; David I. Klein

[57] ABSTRACT

A night lamp includes a cylindrical member disposed in a body so as to form an annular slot. A board is secured on top of the cylindrical member. Two prongs are secured to the board, a light bulb is connected to the prongs. A cap is slidably engaging with the prongs and has a peripheral wall slidably engaged in the annular slot. A spring biases the cap away from the body so as to shield and protect the prongs and in order to prevent users from getting electric shocks.

2 Claims, 4 Drawing Sheets

NIGHT LAMP HAVING A SAFETY DEVICE

BACKGROUND OF THE INVENTION

1. Field of the Invention

The present invention relates to a night lamp, and more particularly to a night lamp having a safety device.

2. Description of the Prior Art

Typical night lamps comprise a transparent body having a light bulb provided therein, and two prongs for connecting to an electric source so as to energize the light bulb in order to provide light during the night. However, the prongs of the night lamps have not been suitably shielded such that the users, particularly the children, may get an electric shock inadvertently when playing or when plugging the prongs into the electric sockets.

The present invention has arisen to mitigate and/or obviate the afore-described disadvantages of the conventional night lamps.

SUMMARY OF THE INVENTION

The primary objective of the present invention is to provide a night lamp having a safety device for protecting the users from electric shocks.

In accordance with one aspect of the invention, there is provided a night lamp comprising a body including a cylindrical member provided therein so as to define an annular slot, a board secured on top of the cylindrical member and including a peripheral portion laterally extended beyond the cylindrical member so as to define flange means, two prongs secured to the board, a light bulb connected to the prongs, a cap including two orifices formed therein for slidably engaging with the prongs, the cap including a peripheral wall member extended downward therefrom for slidably engaging in the annular slot, the wall member including a bottom portion having projection means formed thereon for engaging with the flange means so as to prevent the cap from disengaging from the body, and means for biasing the cap away from the body so as to shield and protect the prongs and in order to prevent users from getting electric shocks.

The wall member includes at least one split formed therein for increasing resilience thereof so as to facilitate the engagement of the projection means over the flange means.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
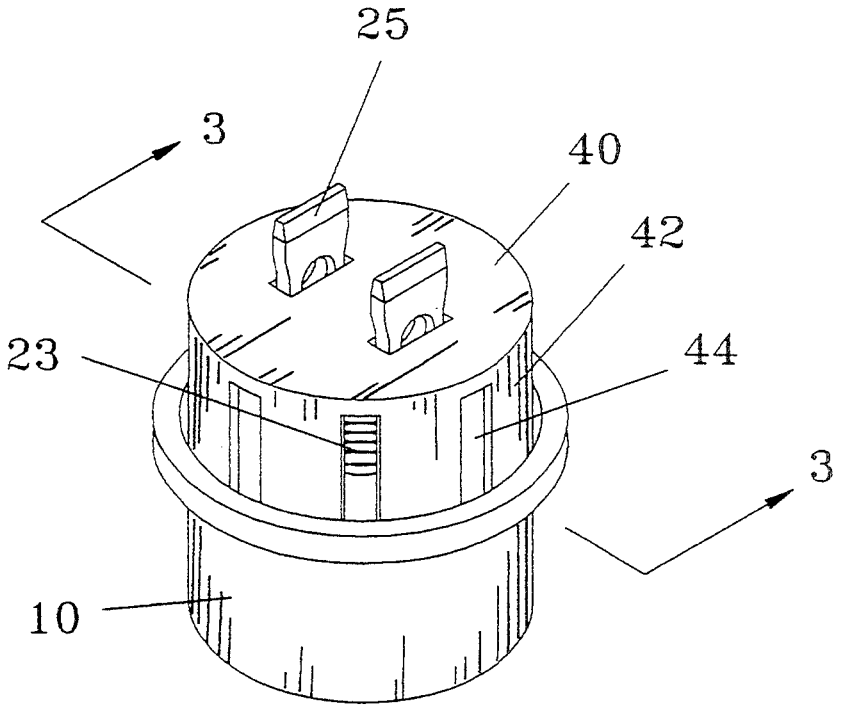
FIG. 1 is a perspective view of a night lamp in accordance with the present invention.
Figure 2:
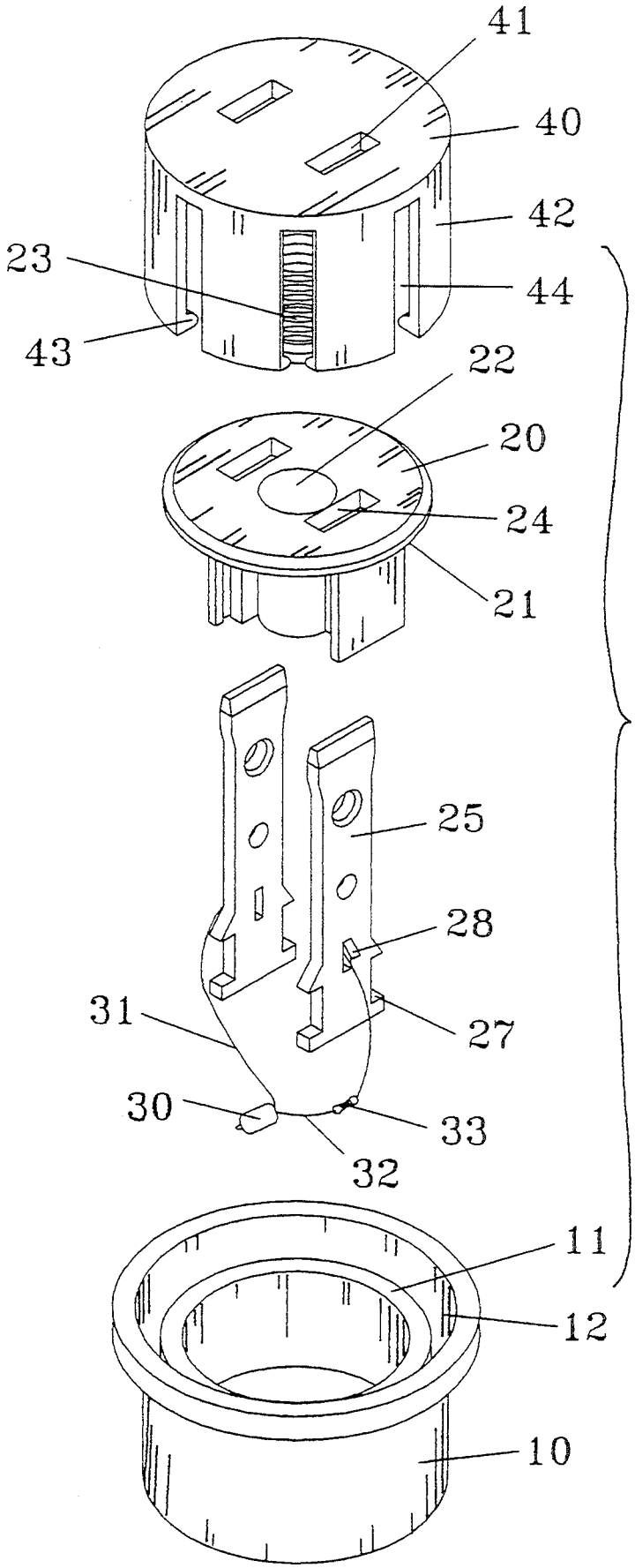
FIG. 2 is an exploded view of the night lamp.
Figure 3:
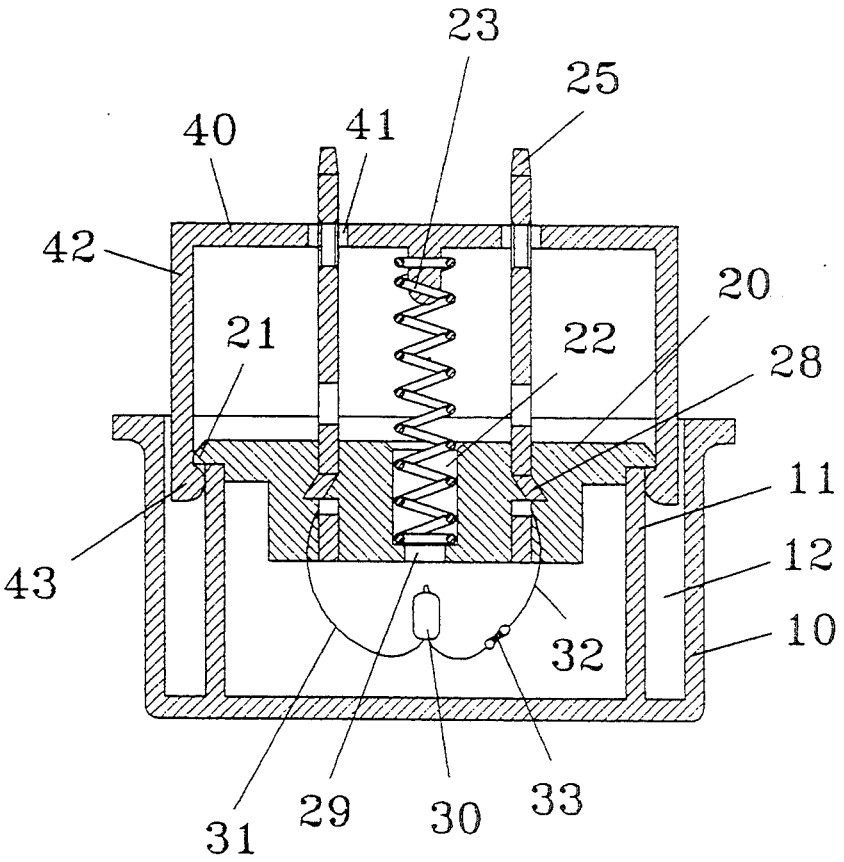
FIGS. 3 and 4 are cross sectional views taken along lines 3—3 of FIG. 1.

Referring to the drawings, and initially to FIGS. 1 to 3, a night lamp in accordance with the present invention comprises a transparent body 10 including a cylindrical member 11 provided therein so as to define an annular slot 12 between the body 10 and the cylindrical member 11. The cylindrical member 11 has a height slightly shorter than that of the body 10. A board 20 of electric insulating material is engaged on top of the cylindrical member 11 and includes a peripheral portion 21 laterally extended outward beyond the cylindrical member 11 so as to define an annular flange 21. The board 20 may be secured to the cylindrical member 11 by adhesive materials or ultrasonic "beating" processes. The board 20 includes a cavity 22 formed in the upper portion for engaging with a spring 23, two apertures 24 for engaging with two prongs 25, and two depressions formed in the bottom portion. The prongs 25 include two ears 27 engaged in the depressions and secured to the board 20, and include ratchet means 28 formed thereon for engaging with the board 20 so as to further secure the prongs 25 to the board 20. A hole 29 is formed in the center portion of the board 20 for communicating the cavity 22 with the space formed within the cylindrical member 11.

A light bulb 30 includes two electrodes connected to the prongs 25 with two wires 31, 32. A resistor 33 is engaged in the wire 32. The prongs 25 may be engaged with socket which is connected to electric source so as to energize the light bulb 30. The hole 29 of the board 20 is provided for dissipating heat that may be generated by the light bulb 30. A cap 40 includes two orifices 41 formed therein for slidably engaging with the prongs 25, and includes a peripheral wall member 42 extended downward therefrom for slidably engaging in the annular slot 12. The wall member 42 includes an annular projection 43 extended radially inward from the bottom portion thereof for engaging with the annular flange 21 of the board 20 so as to prevent the cap 40 from disengaging from the body 10. The wall member 42 includes a number of splits 44 formed therein so as to increase the resilience of the wall member 42 such that the annular projection 43 may engage over the annular flange 21 of the board 20. The spring 23 is biased between the cap 40 and the board 20 for biasing the cap 40 away from the board 20 so as to shield and protect the prongs 25 in order to prevent the users from getting electric shocks.

Figure 4:
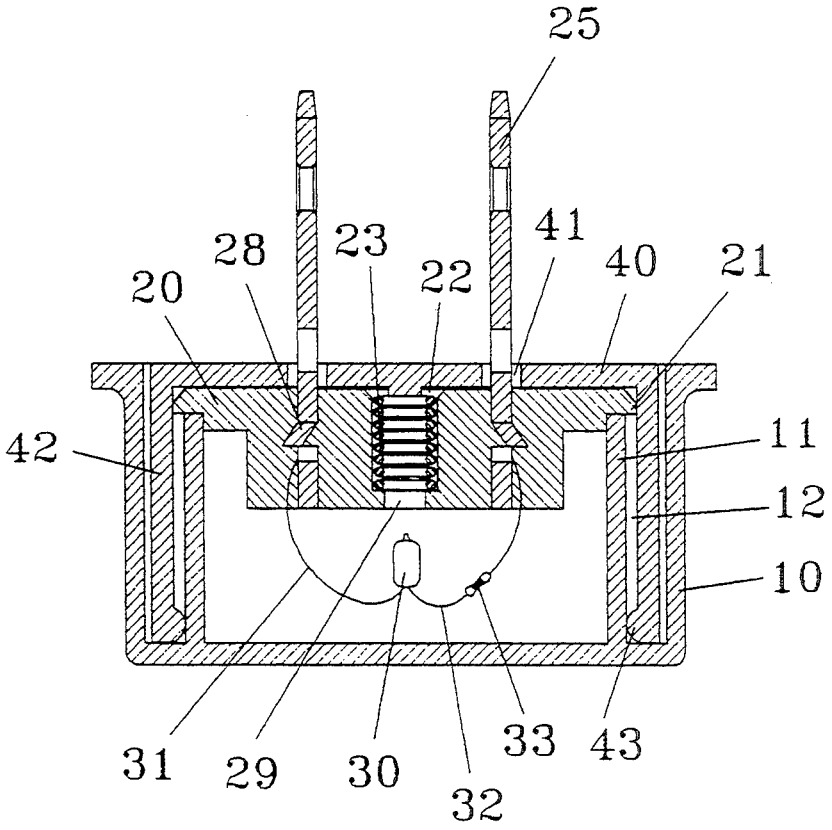

In operation, as shown in FIG. 4, when the prongs 25 are engaged or plugged into sockets, the cap 40 may be forced toward the body 10 against the spring 23, and the wall member 42 of the cap 40 may be engaged inwards of the annular slot 12 such that the prongs 25 may be engaged into sockets. When the prongs 25 are plugged into the socket, the light bulb 30 may be energized in order to provide light during the night.

Accordingly, the night lamp in accordance with the present invention includes a safety device for suitably shielding and protecting the prongs so as to prevent the users from getting electric shocks.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A night lamp comprising:

a body including a cylindrical member provided therein so as to define an annular slot, a board secured on top of said cylindrical member and including a peripheral portion laterally extended beyond said cylindrical member so as to define flange means, two prongs secured to said board, a light bulb connected to said prongs, a cap including two orifices formed therein for slidably engaging with said prongs, said cap including a peripheral wall member extended downward therefrom for slidably engaging in said annular slot, said wall member including a bottom portion having projection means formed thereon for engaging with said flange means so as to prevent said cap from disengaging from said body, and means for biasing said cap away from said body so as to shield and protect said prongs and in order to prevent users from getting electric shocks.

2. A night lamp according to claim 1, wherein said wall member includes at least one split formed therein for increasing resilience thereof so as to facilitate the engagement of said projection means over said flange means.

* * * * *